US006154897A

United States Patent [19]

Paini

[11] Patent Number: 6,154,897

[45] Date of Patent: Dec. 5, 2000

[54] SINGLE COMMAND MIXER DEVICE FOR TAPS

[75] Inventor: Marco Paini, Pogno, Italy

[73] Assignee: Paini SpA Rubinetterie, Pogno, Italy

[21] Appl. No.: 09/280,060

[22] Filed: Mar. 29, 1999

[30] Foreign Application Priority Data

May 29, 1998 [IT] Italy ..... UD98A0091

[51] Int. Cl.[7] ..... E03C 1/04

[52] U.S. Cl. ..... 4/677; 137/218

[58] Field of Search ..... 4/675–678; 137/218, 137/625.46, 636.4

[56] References Cited

U.S. PATENT DOCUMENTS 5,022,429 6/1991 Rollini et al. ..... 137/218
5,575,424 11/1996 Fleischmann ..... 4/677 X
5,701,926 12/1997 Luisi ..... 137/218
5,845,345 12/1998 Ko ..... 4/678

FOREIGN PATENT DOCUMENTS 9424379 10/1994 WIPO ..... 4/677

*Primary Examiner*—Charles E. Phillips
*Attorney, Agent, or Firm*—Stevens, Davis, Miller & Mosher, LLP

[57] ABSTRACT

Device for a mixer tap comprising a substantially tubular central body (15), inside which there is a mixer assembly (21), a first pipe (16) to feed the cold water, a second pipe (17) to feed the hot water and an outlet pipe (19) for the water, a substantially cylindrical connection element (25) being housed inside the central body (15) arranged between the mixer assembly (21) and the water feeder pipes (16, 17) and water outlet pipe (19), means (26, 27, 30) being provided in the said connection element (25) to house at least a non-return valve (35) or a vacuum breaker valve (36).

12 Claims, 2 Drawing Sheets

SINGLE COMMAND MIXER DEVICE FOR TAPS

FIELD OF THE INVENTION

This invention concerns a single command mixer device for taps, as set forth in the main claim.

To be more exact, the invention refers to an inner device inside a tap for a sink, wash basin, bath tub, shower, bidet, or any other article of sanitation, of the type with a single command, where a single actuation lever is suitable to command the opening and closing of delivery, the regulation of the quantity of water delivered and the mixture of hot and cold water.

The device according to the invention is provided with non-return valves arranged on the channels feeding the hot and cold water, and with a so-called vacuum breaker valve.

BACKGROUND OF THE INVENTION

The state of the art includes various types of taps for sanitation articles, with different shapes and sizes, wherein the water is mixed in a mixer assembly or mixer cartridge, mounted inside a central metallic body and commanded by a single lever suitable to rotate both on a vertical and horizontal plane.

Taps with the command lever arranged on the upper part are very common: they are very easy for the user to operate. In taps such as these the command lever is displaced up or down to open or close the delivery of water, or to regulate the flow, and towards the left or right to mix the hot and cold water so as to obtain the suitable temperature.

The terminal ends of the hot and cold water feeder pipes are connected to the lower part of the mixer assembly, also one end of the outlet or delivery pipe which, by means of a flexible element, terminates on the outlet mouth of the tap.

In taps such as are known in the state of the art, a non-return return valve is inserted in each water feeder pipe, outside the mixer assembly and very far therefrom. This creates problems for those who install and maintain the taps, since it is very inconvenient to access the points where the valves are located.

Moreover, in taps such as are known in the state of the art, some parts of the taps which are in contact with the water are made of metallic alloys, such as brass, which also contain lead, even though in small quantities.

This is a considerable disadvantage, as lead is an element which is considered highly cancerogenous and therefore to be avoided, to the extent that in some countries there are legal restrictions, like the NSF 61 standard in the USA, which limit the presence of lead to extremely low percentages.

The present Applicant has designed and embodied this invention to overcome these shortcomings and to obtain further advantages.

SUMMARY OF THE INVENTION

The invention is set forth and characterised in the main claim, while the dependent claims describe other characteristics of the main embodiment.

The principal purpose of the invention is to obtain a device for a mixer tap wherein the non-return valves, that is, those valves which prevent the flow of water from returning from the mixer assembly to the feeder pipes, are easily installed and, if and when necessary, replaced.

A second purpose of the invention is to obtain a device for a mixer tap wherein the drinking water never comes into contact with pieces containing lead.

Another purpose of the invention is to achieve a device which allows an easy, precise and immediate coupling of the mixer assembly and the upper terminal ends of the water feeder and water outlet pipes.

A further purpose of the invention is to achieve a device which will consist of simple elements, easy and economical to produce and to assemble, and wherein the workings of the tap body and the other elements will not require narrow tolerances.

BRIEF DESCRIPTION OF THE DRAWINGS

These and other characteristics of the invention will become clear from the following description of a preferred form of embodiment, given as a non-restrictive example, with the aid of the attached drawings, wherein.

DETAILED DESCRIPTION OF PREFERRED EMBODIMENT

Figure 1:
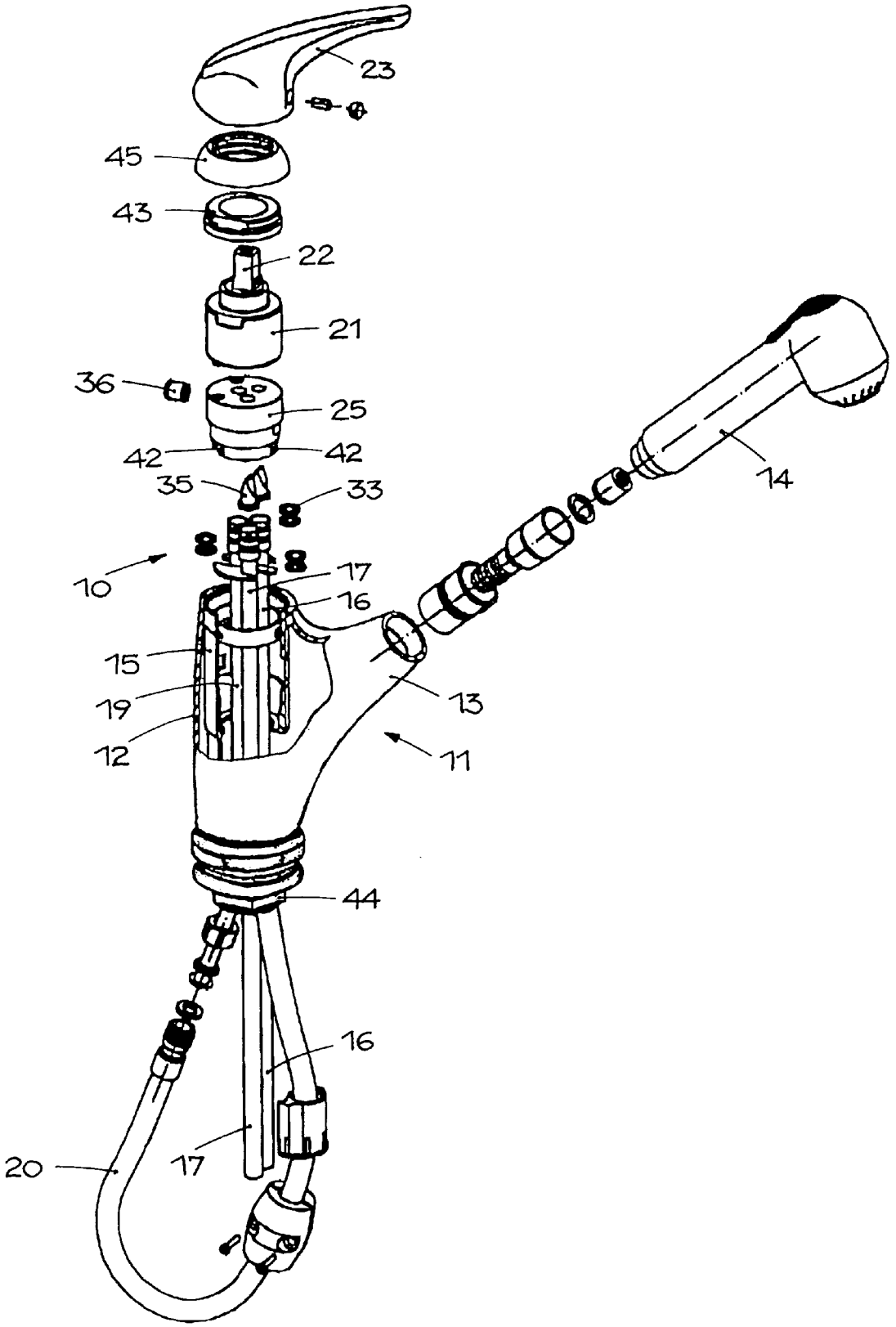
FIG. 1 is a prospective and exploded view of a tap on which a device according to the invention is mounted, in a preferred form of embodiment.

With reference to the attached drawings, a device 10 according to the invention is shown inserted into a tap 11 comprising a sleeve 12, substantially tubular in shape, provided with an inclined lateral part 13, on which a removable shower 14, of a known type, is suitable to be inserted.

Inside the sleeve 12 is inserted a central body 15, also tubular in shape, inside which a feeder pipe 16 to feed the cold water, a feeder pipe 17 to feed the hot water, and an outlet pipe 19 for the mixed water to the shower 14 are arranged. A flexible pipe 20, for example made of rubber, connects the lower end of the pipe 19 to the shower 14. The pipes 16, 17 and 19 are made of a material which does not contain lead, for example copper, or of any material which does not release lead when in contact with water.

The tap 11 also comprises a mixer cartridge, or mixer assembly 21 of a known type, which has at least the parts which are in contact with the water made of a non-toxic material and provided with an upper rod 22, which is suitable to be connected to a single command lever or knob 23.

The mixer cartridge 21, by means of oscillating and rotating movements of the upper rod 22, is suitable to shut off the delivery of the water or to regulate the quantity to be delivered through the shower 14, and also to mix the hot and cold water and thus to regulate the temperature of the mixed water coming out of the shower 14.

Figure 3:
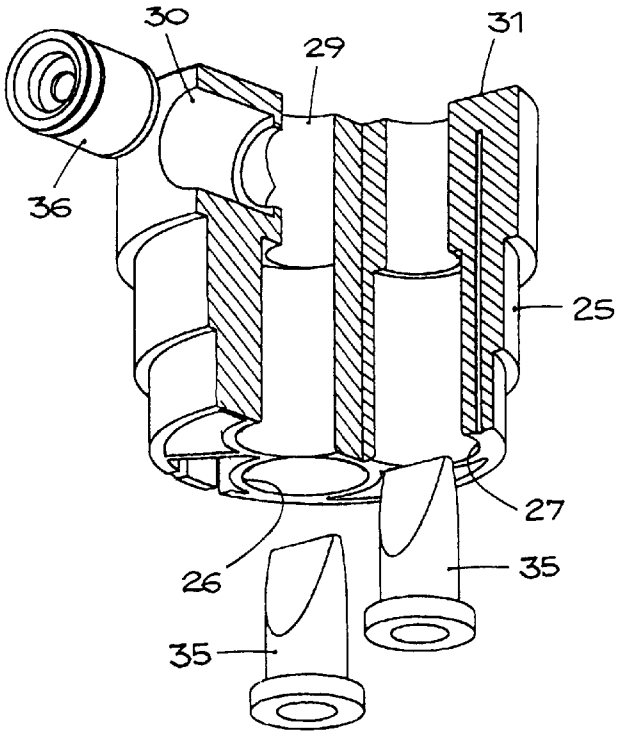
FIG. 3 is an enlarged detail, partly in section, of FIG. 1.

According to a characteristic feature of the invention, the device 10 comprises a substantially cylindrical element 25, made of non-toxic material, inside which three through channels 26, 27 and 29, arranged substantially parallel to each other, are made (FIG. 3). A fourth channel 30 is made on the element 25 orthogonal to the three channels 26, 27 and 29, so as to make the channel 29 communicate with the outside.

Figure 2:
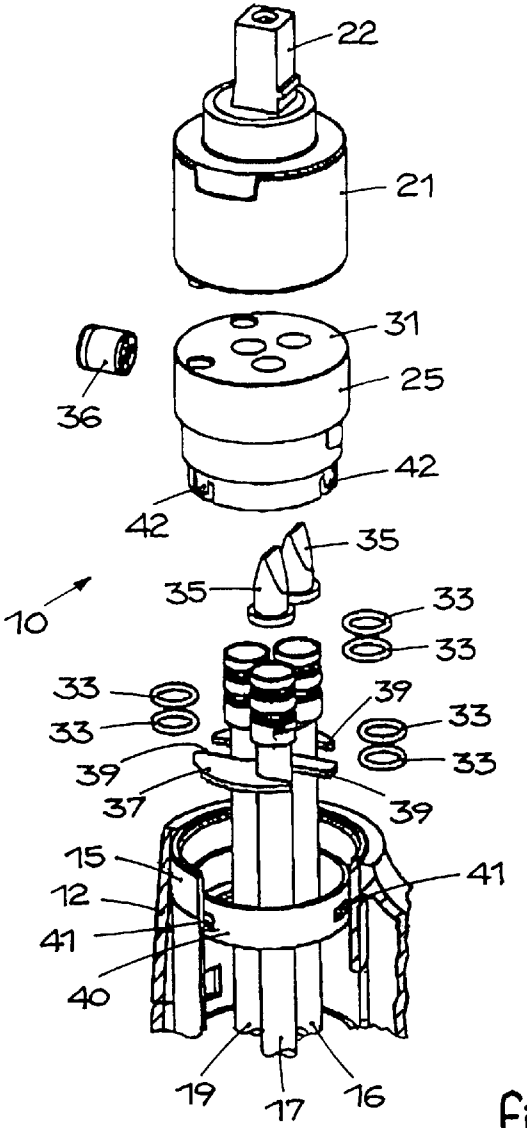
FIG. 2 is an enlarged detail of FIG. 1.

The upper surface 31 of the element 25 is suitable to be coupled in a watertight manner with the mixer cartridge 21 (FIGS. 1 and 2), while the lower part of each channel 26, 27 and 29 is suitable to receive the pipes 16, 17 and respectively 19, and to couple therewith in a water-tight manner.

A pair of sealing rings 33, known as "O-rings", are suitable to be arranged on the upper terminal part of each of the pipes 16, 17 and 19.

Inside each of the channels 26 and 27 a non-return valve 35 of a known type is suitable to be inserted. The non-return valve 35 prevents the return of the flow of water, and is also known as a duck bill valve.

Inside the channel 30 a vacuum breaker valve 36 of a known type is suitable to be inserted. It is suitable to prevent the water flowing back from the outlet pipe 19 towards the feeder pipes 16 and 17 in the event of a depression in the latter and a simultaneous malfunction of the non-return valves 35.

A flange 37, equipped with seatings or grooves 39, is suitable to hold the upper terminal ends of the pipes 16, 17 and 19 positioned in the element 25.

A closing ring 40 is equipped with eyelets 41 to couple with the element 25 by means of the corresponding elastic teeth 42 of the latter.

The ring 40 is inserted inside the central body 15 and acts as a stop and support element for the flange 37 and the pipes 16, 17 and 19.

An upper ring nut 43 clamps the mixer cartridge 21 onto the central body 15, while a lower ring nut 44L clamps the central body 15 onto the sleeve 12. An element 45 to cover the ring nut is screwed onto the upper terminal part of the cartridge 21, around the rod 22.

The device 10 and the tap 11 are assembled as follows:

First of all, the valves 35 and 36 are optionally inserted into the channels 26, 27 and 30 of the element 25.

Then the upper ends of the pipes 16, 17 and 19 are inserted inside the corresponding channels 26, 27 and 29, after having arranged the sealing rings 33 in the appropriate manner on the upper ends of the pipes 16, 17 and 19.

Then the flange 37 is mounted so that the pipes 16, 17 and 19 are inserted into the grooves 39.

The ring 40 is then coupled with the element 25, thus preventing the flange 37 from disconnecting from the pipes 16, 17 and 19. In this way, moreover, the pipes 16, 17 and 19 are held tightly inserted in the corresponding channels 26, 27 and 29; also, each optional non-return valve 35 is held housed in the upper part of the corresponding channel 26, 27.

The assembly thus formed is inserted into the central body 15 from above.

Then, the mixer cartridge 21 is mounted above the element 25, which thus also becomes a support element for the cartridge 21. The watertight seal between the element 25 and the cartridge 21 is obtained by means of the appropriate rubber elements arranged on the lower part of the latter, of a known type and not shown in the drawings.

The mixer cartridge 21 is clamped into the central body 15 by means of the upper ring nut 43.

The central body 15 is inserted into the sleeve 12, from the bottom upwards, and the two elements are clamped together by means of the lower ring nut 44.

Finally, the ring nut covering element 45 is screwed onto the upper part of the mixer cartridge 21 and the lever 23 is screwed onto the rod 22.

As can be noted, thanks to the device 10 according to the invention, in order to be assembled, the tap 11 does not need any welding or any particular and complex operations to position pieces, even rather small ones, with respect to other pieces.

In this way, moreover, all the parts in contact with water are made of materials which do not contain lead, not even in minimum amounts.

It is clear that, although the device 10 according to the invention is shown here in a preferential application, inserted in a single aperture tap 11, provided with a removable shower 14, typically for a kitchen sink, the device 10 can be applied on any type of tap or for any other type of article.

It is also obvious that modifications and/or additions can be made to the device 10 described heretofore, but they shall remain within the field and scope of the invention.

For example, the pipes 16 and 17, instead of being rigid, as shown here in the drawings, can be of the flexible type, each provided with a rigid upper terminal part, suitable to receive the sealing rings 33 and to couple with the corresponding channels 26 and 27 of the element 25.

What is claimed is:

1. A device for a mixer tap comprising:

substantially tubular central body (15), a mixer assembly (21) inside the substantially tubular central body (15), a first pipe (16) to feed cold water, a second pipe (17) to feed hot water and an outlet pipe (19) for the water, wherein a substantially cylindrical connection element (25) is housed inside the central body (15) arranged below the mixer assembly (21) to be between the mixer assembly (21) and the water feeder pipes (16, 17) and water outlet pipe (19), wherein each of the pipes (16, 17, and 19) has an end disposed within the tubular central body (15), the connection element (25) has an upper surface (31) suitable to be coupled in a watertight manner with the lower part of the mixer assembly (21), a first through longitudinal channel (26), a second through longitudinal channel (27), and a third through longitudinal channel (29), the first, second and third through longitudinal channels (26, 27, 29) are substantially parallel to each other, and a fourth channel (30) is substantially orthogonal to the first, second and third through longitudinal channels (26, 27, 29), wherein the fourth channel (30) of the connection element (25), communicates on one side with the third channel (29) and on the other side with the lateral and external side of the connection element (25) such that the third through longitudinal channel (29) communicates with the lateral and external side of the connection element (25), each end of the three pipes (16, 17, 19) is disposed within a corresponding one of the three through longitudinal channels (26, 27, 29) in a watertight manner, and each one of the three through longitudinal channels (26, 27, 29) is suitable to house at least a non-return valve (35) and the fourth channel (30) is suitable to house a vacuum breaker valve (36).

2. The device as in claim 1, wherein the connection element (25) comprises the first through channel (26) with a part suitable to receive and couple in a watertight manner with the first feeder pipe (16) and an opposite end which can be connected in a watertight manner with the mixer assembly (21), the second through channel (27) with a part suitable to receive and couple in a watertight manner with the second feeder pipe (17) and an opposite end which can be connected in a watertight manner with the mixer assembly (21), and the third through channel (29) with a part suitable to receive and couple in a watertight manner with the outlet pipe (19) and an opposite end which can be connected in a watertight manner with the mixer assembly (21).

3. The device as in claim 2, wherein sealing rings (33) are suitable to cooperate with an upper terminal 30 end of each of the pipes (16, 17, 19) and the corresponding part of the channels (26, 27, 29) to achieve the watertight connection between the pipes (16, 17, 19) and the connection element (25).

4. The device as in claim 2, wherein a first nonreturn valve (35) can be inserted in the first channel (26) and a second non-return valve (35) can be inserted into the second channel (27).

5. The device as in claim 2, wherein the vacuum breaker valve (36) can be inserted in correspondence with the third channel (29).

6. The device of claim 1, wherein the connection element (25), has substantially the same external diameter as the mixer assembly (21).

7. The device as in claim 2, wherein a flange (37) provided with seatings (39) is suitable to hold assembled the upper terminal ends of the water feeder and outlet pipes (16, 17, 19) to keep them positioned inside the channels (26, 27, 29).

8. The device as in claim 7, wherein the connection element (25) is made of non-toxic material.

9. The device as in claim 7, wherein a support ring (40) is suitable to couple with the connection element (25) to keep the flange (37) and the pipes (16, 17, 19) positioned with respect to the connection element (25).

10. The device as in claim 9, wherein the connection element (25) is made of non-toxic material.

11. The device as in claim 2, wherein the connection element (25) is made of non-toxic material.

12. The device as in claim 1, wherein the connection element (25) is made of non-toxic material.

* * * * *